US008123581B2

(12) United States Patent
Aschauer

(10) Patent No.: US 8,123,581 B2
(45) Date of Patent: Feb. 28, 2012

(54) AVALANCHE RESCUE DEVICE

(76) Inventor: Peter Aschauer, Gräfelfing (DE)

( * ) Notice: Subject to any disclaimer, the term of this patent is extended or adjusted under 35 U.S.C. 154(b) by 144 days.

(21) Appl. No.: 12/519,443

(22) PCT Filed: Dec. 8, 2007

(86) PCT No.: PCT/EP2007/010703

§ 371 (c)(1),
(2), (4) Date: Jun. 16, 2009

(87) PCT Pub. No.: WO2008/077464

PCT Pub. Date: Jul. 3, 2008

(65) Prior Publication Data

US 2010/0112880 A1 May 6, 2010

(30) Foreign Application Priority Data

Dec. 22, 2006 (EP) ..... 06026770

(51) Int. Cl.
*B63C 9/00* (2006.01)

(52) U.S. Cl. ..... 441/80; 116/210; 224/153

(58) Field of Classification Search ..... 441/80, 441/82; 224/153, 155, 580, 582
See application file for complete search history.

(56) References Cited

U.S. PATENT DOCUMENTS

| | | | | |
|---|---|---|---|---|
| 4,449,655 | A * | 5/1984 | Germe | 224/153 |
| 4,883,207 | A * | 11/1989 | McArthur | 224/153 |
| 5,639,005 | A | 6/1997 | Chouinard | |
| 5,749,503 | A | 5/1998 | Wulf et al. | |
| 5,819,999 | A * | 10/1998 | Tennant | 224/155 |
| 5,839,932 | A * | 11/1998 | Pierce et al. | 441/80 |
| 6,158,380 | A * | 12/2000 | Aschauer et al. | 116/210 |
| 6,216,926 | B1 * | 4/2001 | Pratt | 224/153 |
| 7,270,077 | B2 * | 9/2007 | Beck | 116/210 |

FOREIGN PATENT DOCUMENTS

| | | |
|---|---|---|
| DE | 2326850 | 12/1974 |
| DE | 29709269 | 8/1997 |
| DE | 3237060 | 8/1998 |
| WO | 96/35479 | 11/1996 |
| WO | 98/33559 | 8/1998 |

(Continued)

OTHER PUBLICATIONS

Notice of Opposition filed by SNOWPULSE SA on Sep. 2, 2010 Against European Patent EP 1935457.

(Continued)

*Primary Examiner* — Lars A Olson
(74) *Attorney, Agent, or Firm* — Bacon & Thomas, PLLC

(57) ABSTRACT

An avalanche rescue device includes as functional parts at least one inflatable buoyant body attachable close to the body of the user, a filling unit for the buoyant body, and a compressed gas unit having a compressed gas tank and a release unit. The device is provided with a carrier system for the user to carry the functional parts on his or her back. The carrier system includes at least one flexible fabric element and is provided with a first connecting mechanism which interacts with a second connecting mechanism of a separate container such that the carrier system can be detachably connected to the container to form a jointly-manipulable backpack and which is thereby sandwiched between the user's back and the container in the conjoined state. This avalanche rescue device is universally applicable compared to the previously-known avalanche rescue devices.

11 Claims, 6 Drawing Sheets

FOREIGN PATENT DOCUMENTS

WO 2004/033360 A2 4/2004

OTHER PUBLICATIONS

Figure 1:
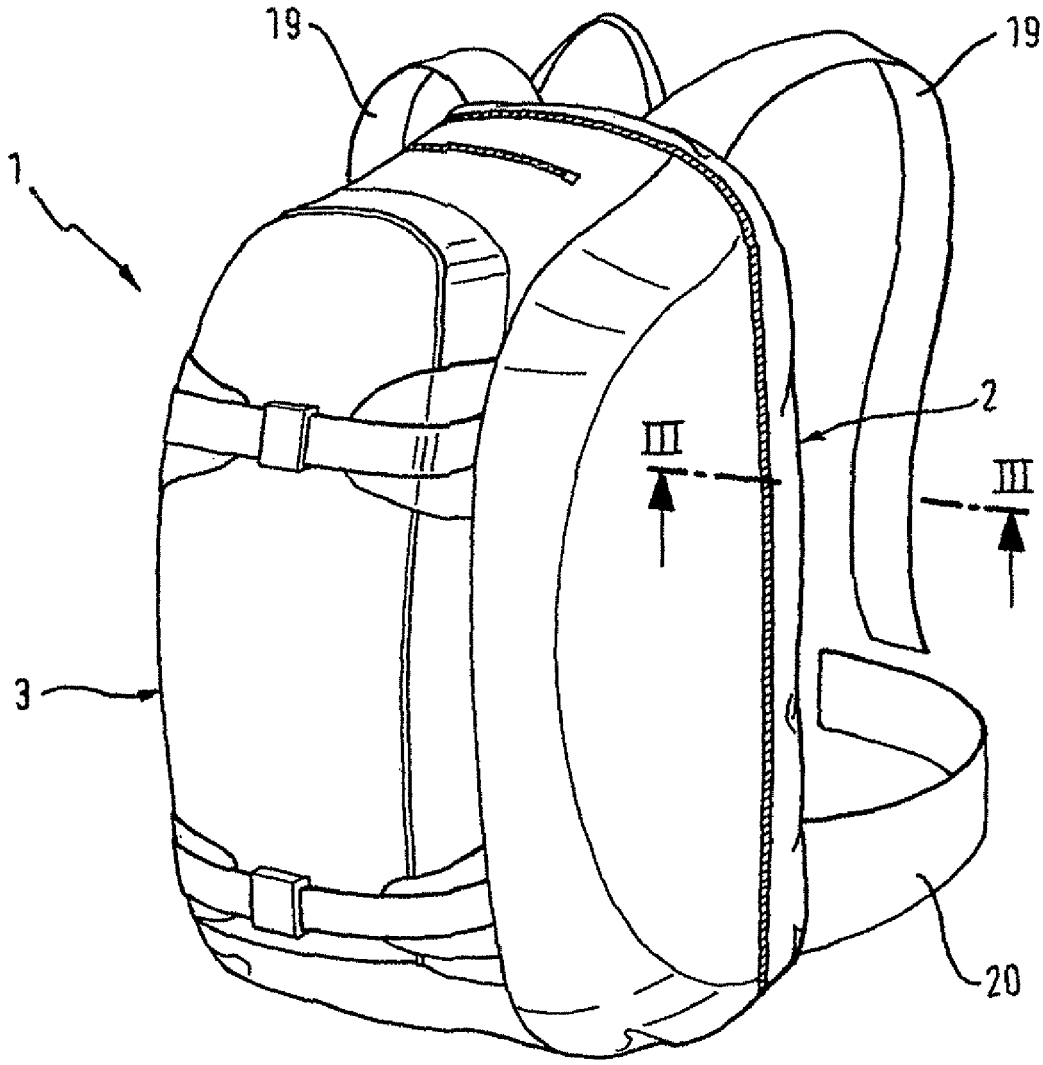

Opposition Brief of SNOWPULSE SA filed in support of opposition against EP 1935457, Sep. 2, 2010.

List of Minutes and Presentations given at the Internationale Kommission fur Alpines Rettungswesen *IKAR) conference in Kranjska Gora from Oct. 12-14, 2006 ("2006—Kranjska Gora-Slovenien-Protokoll der Tagung der Kommission fur Bodenrettung Oct. 12-14, 2006 Protokoll und Vortrage") from IKAR website: http://www.ikar-(Document DO1 in SNOWPULSE Opposition).

Minutes of conferences given at the Internationale Kommission fur Alpines Rettungswesen *IKAR) conference in Kranjska Gora from Oct. 12-14, 2006 ("2006-Kranjska-Gora-TC-Minutes-E.pdf") reporting the conference of Mr. Peter Aschauer from ABS GmbH on Oct. 13, 2006 at 11:30 AM: Calculable Chance of Survival for Avalanche Victims, the conference of Mr. Jurg Weber from Mammut on Oct. 13, 2006 at 10:15 AM and the conference of Mr. Yan Berchten from Snowpulse on Oct. 13, 2006 at 12 AM. Document listed on D01. Date of document.

Proceedings of the conference of Mr. Peter Aschauer from ABS GmbH given at the Internationale Kommission fur Alpines Rettungswesen (IKAR) conference in Kranjska Gora on Oct. 13, 2006 ("2006-KG-TR-17-ABS-Kalkulierbare-Chance-Abstract.pdf"). Document listed on D01. Date of document: Oct. 20, 2006. From IKAR website: http://www.ikar-cisa.org/ikar.

Affidavit from Mr. Jurg Weber describing the disclosure made by Mr. Peter Aschauer from ABS GmbH at during his conference on Oct. 13, 2006 and the disclosure of ABS Vario products on the ABS booth during the Internationale Kommission fur Alpines Rettungswesen (IKAR) conference in Kranjska Gora from Oct. 12-14, 2006. Document dated Aug. 31, 2010.

Affidavit from Mr. Yan Berchten from Snowpulse describing the disclosure made by Mr. Peter Aschauer from ABS GmbH at during his conference on Oct. 13, 2006 and the disclosure of aBS Vario products on the ABS booth during the Internationale Kommission fur Alpines Rettungswesen (IKAR) conference in Kranjska Gora from Oct. 12-14, 2006. Document Sep. 1, 2010.

Photography provided Mr. Gebhard Barbisch (WebMaster of the IKAR Website and member of the IKAR) made at the Internationale Kommission fur Alpines Rettungswesen (IKAR) conference in Kranjska Gora from Oct. 12-14, 2006 showing the ABS stand with one product Vario bag on the left (zoom on the Vario bag from this photo provided below).

* cited by examiner

AVALANCHE RESCUE DEVICE

The invention relates to an avalanche rescue device comprising as functional parts at least one inflatable buoyant body attachable close to the body of the user, a filling unit for the buoyant body, a compressed gas unit having a compressed gas tank and a release unit, and with the device being provided with a carrier system for the user to carry said functional parts on his/her back.

In the present case, an avalanche rescue device denotes a device for rescuing people, in particular from avalanches.

Devices of this type have been used for years and are well described including, for example, in the German P 32 37 060 printed publication.

An improved avalanche rescue device is described in detail in WO 96/35479 (PCT/EP 96/01942). The functional parts described therein, for example the buoyant body, the filling unit for the buoyant body, the compressed gas unit with its compressed gas tank and release unit, can also be used with the avalanche rescue device according to the present invention. It is therefore unnecessary to provide a detailed description of these functional parts; reference is instead made to the cited printed publication.

This known avalanche rescue device is for example provided with a carrying frame for a user's back so as to mount at least some of the functional parts to same, for example the buoyant body, respectively balloons. The carrying frame with the balloons can thus serve both as a rescue device on its own as well as the basis for a backpack.

When the functional parts are mounted in a backpack, for example a rescue backpack, at least some of these functional parts are affixed to a mounting plate integrated into said backpack so as to ensure the necessary stability.

The cited printed publication also describes how it is possible to integrate the functional parts of the avalanche rescue device into a vest or another article of clothing. In this case, fastening elements are also required for at least some of the functional parts and need to be integrated into the cited articles of clothing.

That which is termed functional parts here are noted to be those elements which have a technical relationship relative the operation of the device, and in particular the inflating of the buoyant body.

A further avalanche rescue device of the type at issue here is described in WO 98/33559 (PCT/EP 98/00491). The subject matters specified therein relate to improvements made to the functional parts of such an avalanche rescue device or avalanche rescue system.

Disadvantageous with such known avalanche rescue devices is the fact that they can only be used in the respectively selected design. For example, if the avalanche rescue device is integrated into a vest or a parka, then it always has to be used with that specific article of clothing. If, on the other hand, the avalanche rescue device is incorporated into a backpack, then the device will always need to be carried in conjunction with this specific, initially-selected backpack.

The object which the present invention addresses is that of providing an all-purpose avalanche rescue device which is universally applicable compared to the previously-known avalanche rescue devices.

This object is solved by an avalanche rescue device in accordance with the teaching of the present application.

Among other things, the avalanche rescue device according to the invention is characterized by the carrier system being comprised of at least one flexible fabric element. This carrier system serves to secure the functional parts. In particular, this can be a flexible planar textile, for example a woven nylon or a strap. It is also possible to have a combination of a planar textile or a fabric-like planar textile together with a strap or a plurality of straps. Such fabric elements are known.

What is crucial is for the fabric element to be able to absorb the forces which occur so as to ensure the operational reliability of the avalanche rescue device. This applies in particular to the inflatable buoyant bodies. Hence, the thickness and strength of the fabric element is to be selected in accordance with expected loads. Since the fabric element is flexible, it can optimally adapt to different contours, for example the user's back. Moreover, such fabric elements are lightweight. Rigid mounting plates and inflexible supporting frames are thus avoided.

When a strap is used in the context of the present documents, this can be a single, separate strap. A strap can however also be comprised of a plurality of separate bands of straps which can be sewn together. The individual strap bands can also overlap to some extent. The only crucial factor is—as stated above—that the resulting "aggregate strap" has sufficient strength to absorb the loads which occur during a rescue situation with the buoyant bodies being inflated and the user being given the necessary buoyancy in the avalanche.

The avalanche rescue device according to the invention is further characterized by the carrier system being provided with a first connecting mechanism which interacts with a second connecting mechanism of a separate container such that the carrier system can be detachably connected to the container to form a jointly-manipulable back-pack. The connecting mechanisms are thereby configured or mounted such that the carrier system with the functional parts mounted thereto together with the container affixed thereto is sandwiched between the user's back and the container when the avalanche rescue device is in use on the user's back.

In plan view, namely the view toward the back of the user, the extension of the additional container can be less than that of the carrier system or can also correspond to its dimensions. The container can additionally protrude above and below the carrier system. Laterally, however, the container should not protrude beyond the "base area" of the carrier system since this area is needed for the expansion of the buoyant bodies, respectively balloons, during a rescue situation.

The front face of the container preferably represents the rear face of the carrier system and covers and/or closes this carrier system to the exterior in the conjoined state.

Both the first connecting mechanism as well as the second connecting mechanism can be of any arbitrary type. It must only be ensured that the additional separate container can be connected to the carrier system in the manner described. For example, buttons can serve as a connecting mechanism which, in interaction with the associated buttonholes representing the second connecting mechanism, serve to conjoin the carrier system and the separate additional container. Snap fasteners of known type can also be used for this purpose. Preferably, however, the two connecting mechanisms form a zipper.

A zipper usually consists of two side strips and associated teeth which can be joined or separated using a slider. In the case of the preferred embodiment as described, one side strip is affixed to the carrier system while the other side strip is affixed to the container. Both side strips preferably run nearly completely around the entire exterior of the carrier system, respectively container.

According to a further preferred embodiment, the container is substantially self-contained, however provided with at least one closeable opening through which the container's interior can be accessed from the outside.

The avalanche rescue device according to the invention is not, however, limited to this type of container. One of the substantial advantages of the inventive avalanche rescue device lies precisely in the fact that containers of the most widely varied configurations, for example knapsacks of different sizes, constructions or designs, can be quickly and easily connected to the carrier system by forming a jointly-manipulable unit in the form of a backpack.

A user therefore need only purchase one single carrier system and can then connect it to a container of his choice based on his own needs and/or desires.

In the simplest case, the fabric element of the carrier system consists of a planar textile, which can also be termed backing fabric. This can be woven nylon, for example. This planar textile of course needs to have the appropriate strength in order to be able to transfer the forces which occur.

The carrier system of the inventive avalanche rescue device preferably has a U-shaped base strap in plan view. The side legs of the base strap extend vertically when in the use position while the base of the U-form forms a relatively horizontally-extending segment thereabove.

A waist strap is preferably connected to the base strap near the free ends of the U-form. This waist strap can have two free ends which can be connected together by means of customary mechanisms, for example a buckle. When the avalanche rescue device is positioned on the user, this buckle is usually positioned at the front of the user's body.

The avalanche rescue device according to the invention further comprises preferably two buoyant bodies. One of these buoyant bodies is connected to a vertical leg of the base strap U-form while the other buoyant body is connected to the other vertical leg of the base strap U-form.

It is furthermore preferred for the inventive avalanche rescue device to have the upper end of a left and a right shoulder strap affixed to the horizontally-extending segment of the U-shaped base strap. A left and right hip strap respectively is moreover connected to the base strap at the lower end or in the area of the lower end of the base strap vertical leg. The right shoulder strap is then connectable to the right hip strap to form a harness, for example using a buckle or the like. The same applies to the left shoulder strap and the left hip strap.

The connections in the context of the present documents as regards the carrier system and the strap which constitutes same together with the interacting straps (e.g. base strap) are not to be understood as rigid connections. Instead, all that is intended to be expressed by same is that the connection between the interconnected parts have such a stability that when in use, the inventive avalanche rescue device can absorb the forces which occur and the avalanche rescue device in particular with the associated buoyant bodies remains tightly conjoined to the user and give him the necessary buoyancy such that the rescue function is realized.

It is also possible to join a planar textile to one or more straps. The above-described U-shaped base strap can thus be, for example, sewn onto the planar textile or connected to same in some other way. Further conceivable with the latter embodiment is to interrupt or completely omit the horizontal segment of said U-shaped base strap. In this case, the planar textile then needs to be appropriately dimensioned and/or strong enough to meet the requirements.

Figure 2:
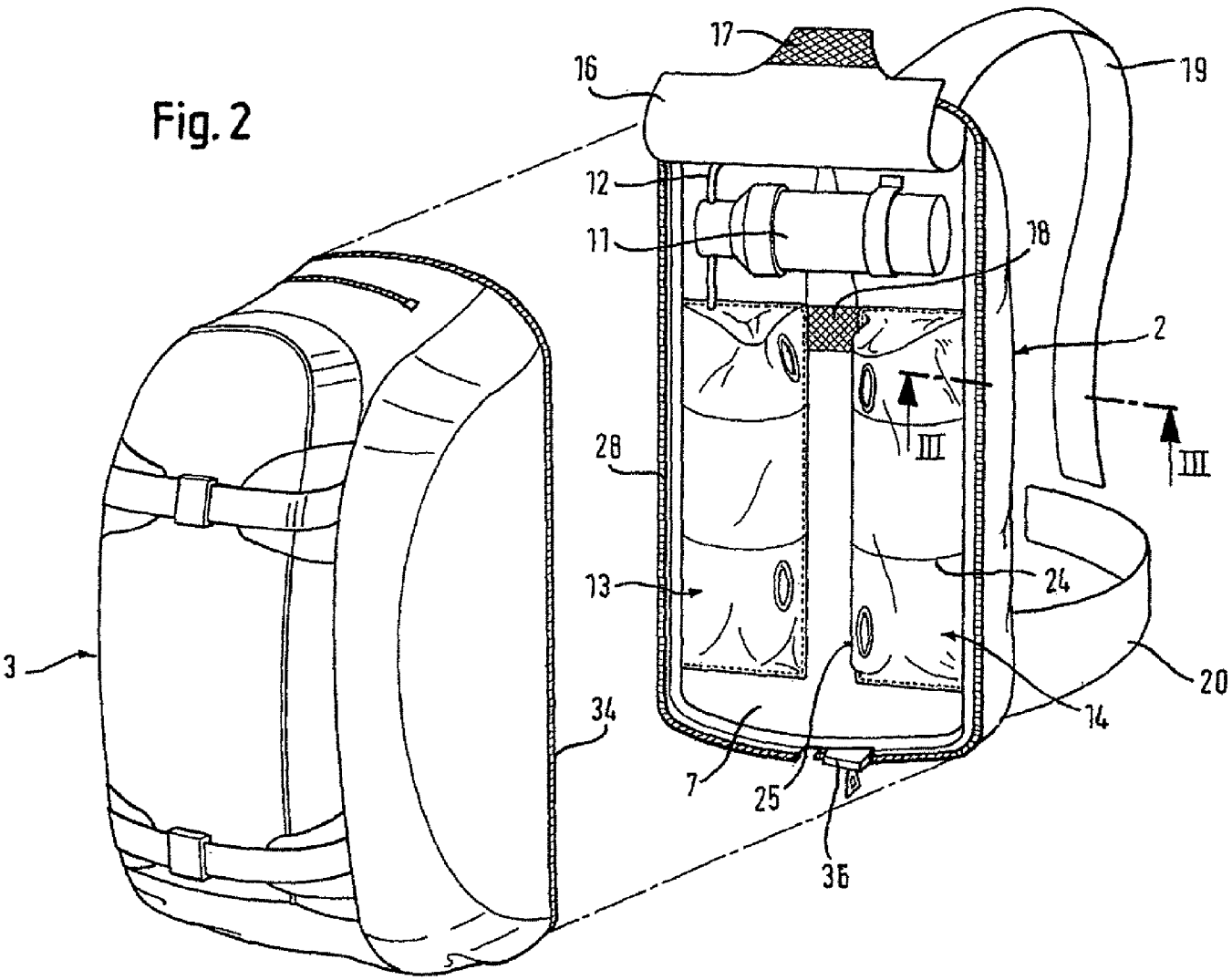
Figure 3:
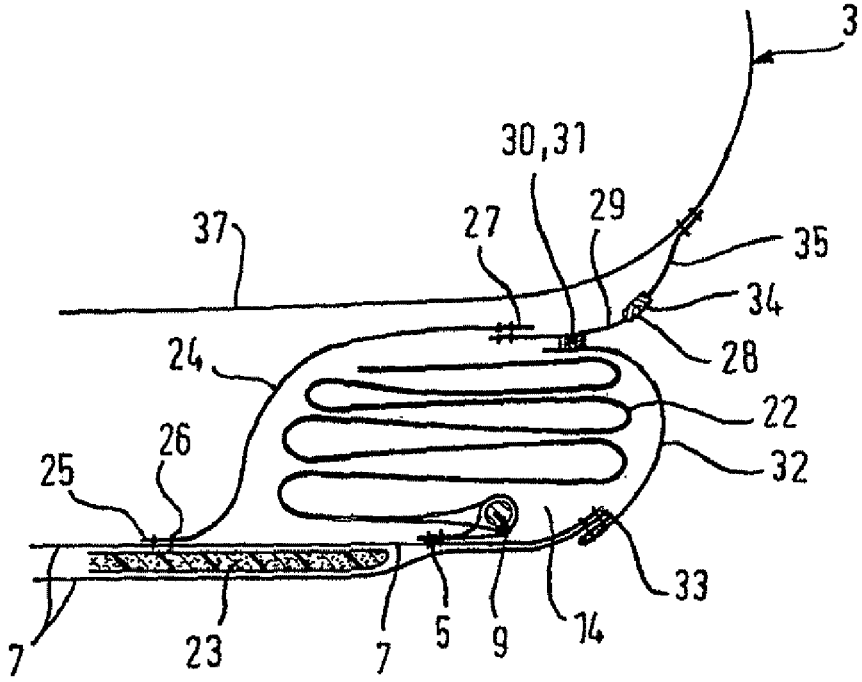
Figure 4:
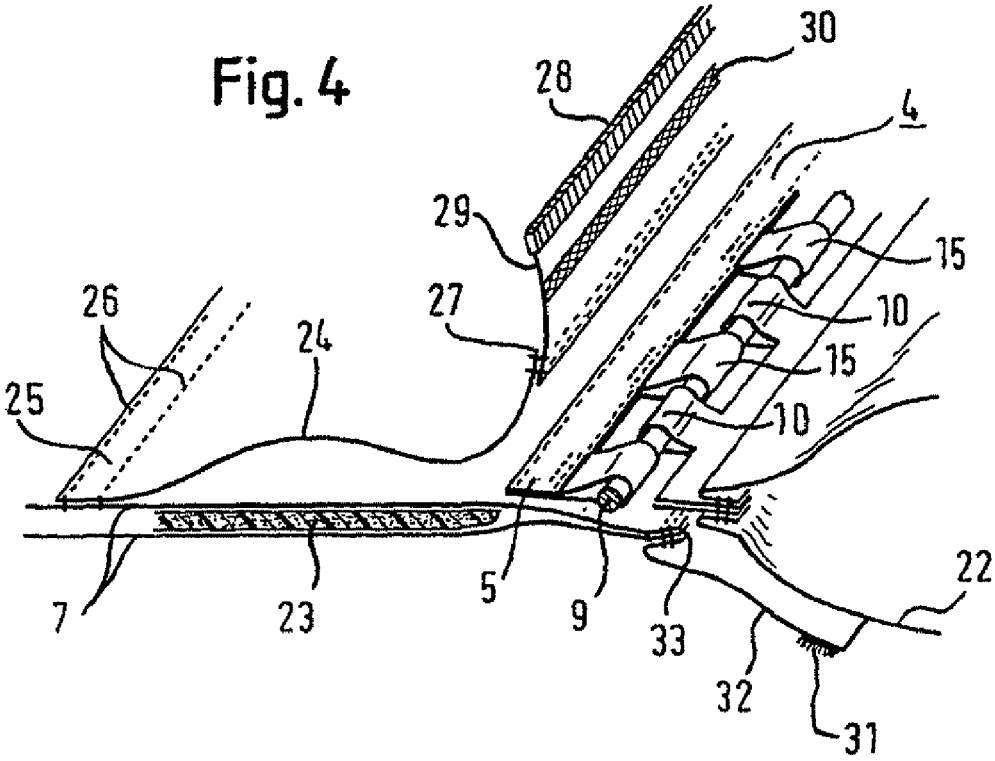
Figure 5:
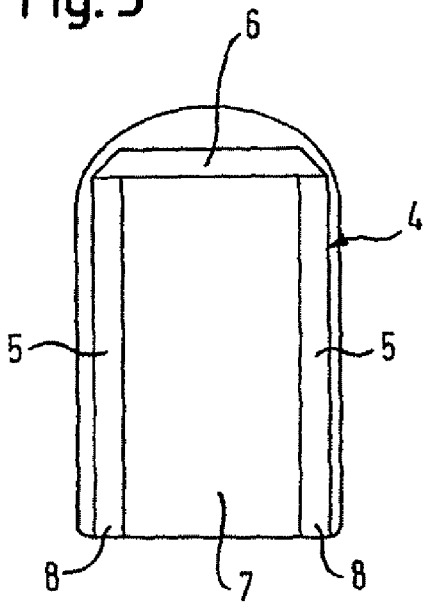
Figure 6:
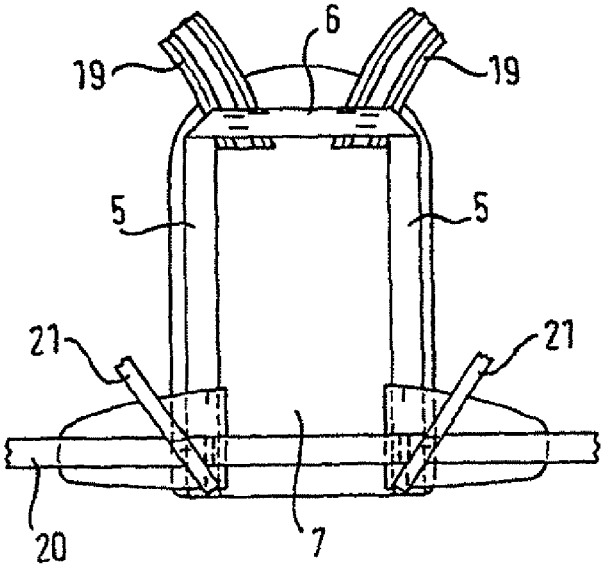
Figure 7:
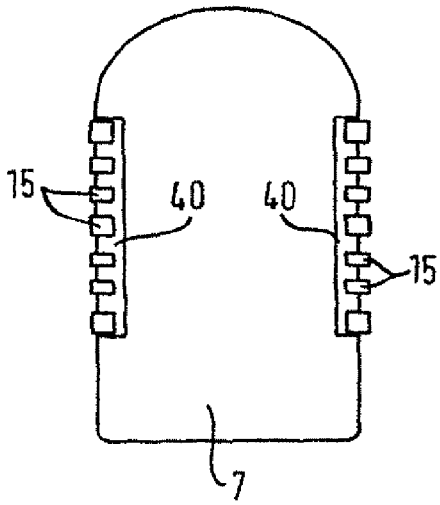
Figure 8:
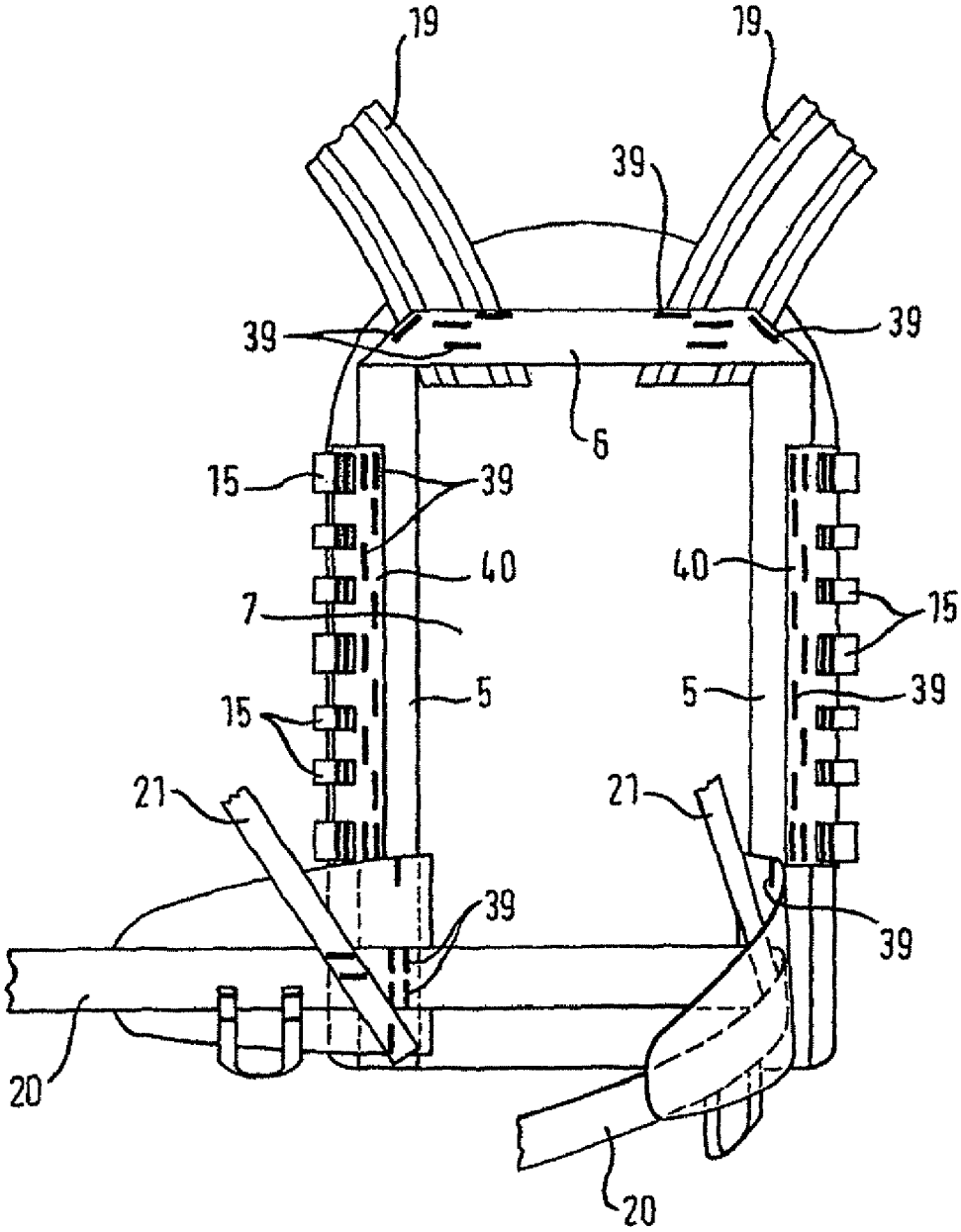

In describing the invention in greater detail, the following will make use of simplified figures, not drawn true to scale, which show a preferred embodiment of the avalanche rescue device according to the invention. The figures thereby show:

FIG. 1 an inventive avalanche rescue device in which the carrier system is connected with an additional separate container into an aggregate unit in the form of a backpack, FIG. 2 an exploded view of the avalanche rescue device shown in FIG. 1, FIG. 3 a section along the line from FIGS. 1 and 2, FIG. 4 a perspective detail view of the sectional view shown in FIG. 3 with unfolded buoyant body, FIG. 5 a schematic view of the U-shaped base strap of the carrier system as seen external the user, FIG. 6 a schematic view similar to that of FIG. 5, whereby the base strap is connected to the shoulder strap and the hip strap, FIG. 7 a simplified and schematic view of a mounting for the buoyant bodies exhibiting loops, FIG. 8 a full overview of the details depicted in FIGS. 5 to 7, and FIG. 9 a view corresponding to that of FIG. 6, however with the carrier system comprised solely of a planar textile.

FIG. 1 shows a perspective view of an avalanche rescue device 1 according to the invention, which is composed of a carrier system 2 for carrying the functional parts and a container 3 connected thereto. The carrier system 2 and the container 3 are joined into a jointly-manipulable unit in the form of a backpack to be worn by the user.

As can be seen particularly from the perspective exploded view of FIG. 2, the carrier system 2 serves to support at least some of the functional parts. Included among these functional parts are, for example, a compressed gas tank 11, a line 12 connected thereto, and two buoyant bodies 22 (not visible in FIG. 2), each respectively positioned within a pocket 13, 14, as will be described in greater detail below.

A flap 16 serves to cover the compressed gas tank 11 and is provided with a Velcro strip 17 which can interact with Velcro strip 18 to produce a hook-and-loop fastening.

Two shoulder straps 19 are arranged at the upper area and two waist straps 20 are arranged at the lower area of the carrier system 2, each being respectively arranged at the right and at the left. In order to simplify the depiction, FIG. 2 only shows the respective right shoulder strap 19 and waist strap 20.

In plan view, the carrier system 2 has a U-shaped base strap 4, which can be seen in particular in FIG. 5. The side legs 5 of base strap 4 extend relatively vertically while the base 6 extends horizontally and above. Hence, the opening of the U-form points downward.

The base strap 4 is sewn onto or otherwise connected to the planar textile 7. This planar textile 7 can be of any arbitrary type and can contribute, together with the base strap 4, to absorbing the forces which occur. The strength and stability of the base strap 4 and the planar textile 7 is coordinated such that the carrier system 2 can absorb the greatest amount of force possible and yet still be as lightweight as possible. The planar textile 7 used is in particular that as frequently used in the manufacture of backpacks and the like, for example a fabric made of synthetic fibers, in particular woven nylon.

In the embodiment as described here, the carrier system 2 thus consists of a combination of a planar textile, a textile fabric 7 respectively, and a base strap 4.

Said fabric 7 constitutes the rear surface of the inventive avalanche rescue device 1 which rests against the back of the user. The base strap 4 can thereby be sewn onto the fabric 7 both from the inside or from the outside. The feature "from the outside" hereby means that the base strap is on the side of the fabric 7 facing away from the user's back while the feature "from the inside" means that the base strap 4 faces the user's back and is thus arranged between the back and the fabric 7. It is also possible to double-up the base strap 4, namely in such a manner that one strap band is positioned to the inside and the other to the outside.

Two shoulder straps 19 are sewn or otherwise connected to the horizontally-extending segment 6, base strap band respectively. In FIGS. 6 and 8, these shoulder straps 19 are only shown in that area in which they are connected to the base strap 4 and, more precisely, with its base 6. These shoulder straps 19 are of course also sewn to connect to fabric 7.

The shoulder straps 19 can each be connected in a manner known per se to a hip strap 21. For example, buckles or similar mechanisms can be used as connecting elements for this purpose. It is also conceivable to dispense with such connecting elements such that the shoulder strap 19 simultaneously also constitutes the hip strap 21.

Each of the hip straps 21 is connected to the base strap 4 in the area of its free end 8 associated with same and also connected to fabric 7, likewise preferably by sewing. The seams 39 are represented in the figures as dashes.

In the embodiment as depicted, the waist strap 20 as well has two free ends which can be connected together in customary fashion, preferably likewise by means of a buckle or the like. The waist strap 20 is moreover of continuous configuration behind the back of the user and thus runs behind the back of the user.

A plurality of loops 15 are connected to each side leg 5 of the base strap 4, for example sewn on. These loops 15 can be sewn individually to the side leg 5 or can also be attached to a separate strap band 40 which is then sewn to the respective side leg 5, such as shown for example in FIGS. 7 and 8. In the embodiment shown in FIGS. 3 and 4, each loop 15 is sewn directly to the leg 5 of the base strap 4.

These loops 15 are spaced apart in the side leg 5 direction and, together with a rod 9 and further loops 10 affixed to the buoyant body 22, form a type of hinge. The rod 9 is hereby extended through alternatingly arranged loops 15 and 10 so as to realize the cited hinge function. Loops 10 are thus also spaced apart from one another longitudinally such that the loops 10 position in the space between the loops 15 and vice versa. FIG. 4 in particular shows this situation clearly. The buoyant body 22 hereby represents a balloon and is of conventional type. In FIG. 4, said buoyant body 22 is shown in the unfolded, inflated position extending laterally from the carrier system 2, as will be addressed further below. This design enables simple and easy replacing of the buoyant body by pulling the rod 9 out through the loops 10 and 15, replacing the buoyant body 22 with a new one, and extending the rod 9 back through the loops 10 and 15.

The planar textile 7 is provided with an elastic, cushioning layer 23. This layer 23 can be arranged between two layers of the fabric, as is shown in FIG. 4. This layer can however also be sewn onto the outer side of fabric 7 or affixed thereto in another manner. This layer is customarily a foam material layer. This elastic layer 23 has no supporting function but rather serves to improve the wearing comfort of the inventive avalanche rescue device 1.

The folded buoyant body 22 is shown in FIG. 3. The manner in which the buoyant body 22 is folded is hereby shown in simplified depiction for the purpose of better representation.

The buoyant body 22, an inflatable balloon in the present case, is accommodated in pocket 14 as shown in FIG. 2. The inventive avalanche rescue device 1 depicted in the figures is thereby equipped with two buoyant bodies 22; i.e. a right and a left one, each stored in the folded state in a respective pocket 13, 14. When the user activates the (not shown) known release unit, a gas as contained in compressed gas tank 11 passes through the line or hoses 12 to the buoyant bodies 22, thereby causing them to inflate and swell laterally to the left and right out of pockets 13, 14 and unfold.

Pocket 14 (cf. FIGS. 2 and 3) is formed between a band of fabric 24 and the fabric 7. When viewed directly, the band of fabric 24 has a relatively rectangular form. The left edge 25 of this band of fabric 24 thereby extends fairly vertically and is sewn to the fabric 7 at point 26. The right vertical edge 27 (FIG. 4) is sewn to the side strip 29 provided with teeth 28. This side strip 29 is provided with a Velcro strip 30 on its side facing the buoyant body 22 which can interact with Velcro strip 31 to produce a hook-and-loop fastening. Said Velcro strip 31 is supported on a second side strip 32 which is sewn from the outside to the lateral edge 33 of fabric 7. Connecting the Velcro strips 30 and 31 together closes the pocket 14 accommodating the folded buoyant body 22.

The left pocket 13 with its associated buoyant body 22 is of analogous albeit mirror-symmetrical configuration. The upper and lower side edges of the band of fabric 24 are directly or indirectly connected to the fabric 7 by means of additional fabric elements.

The teeth 28 mounted to the side strips 29 interact with teeth 34 to form a zipper which is attached to container 3. The affixing of the teeth 34 to the container 3 can ensue in any arbitrary manner. In the embodiment depicted in FIG. 3, these teeth 34 are sewn on via a side strip 35 connecting the fabric or the like comprising the container.

As is evident from FIG. 2, the side strips 29, 32 with the teeth 28, 34 of the zipper nearly completely ring the entire exterior of the carrier system 2 and the container 3, only being interrupted at the lower horizontal area. Said point is where the zipper with teeth 28 and 34 and slider 36 begins and ends from the two side strips.

The front side or front face 37 of container 3 defined by the teeth 34 of container 3 roughly corresponds to the area defined by the teeth 34 of carrier system 2 such that upon a closed zipper (formed by side strips 29, teeth 28, side strips 32, teeth 34 and slider 36), the container 3 is conjoined to the carrier system 2 yet does not protrude beyond the rear face of the carrier system 2 defined by the teeth 28. The front face and the rear face correspond approximately in area.

In the embodiment shown in FIG. 2, the container 3 thereby has a front side 37 (cf. also FIG. 3), which covers the interior of the carrier system 2 to the outside after the zipper formed by the teeth 28 and 34 is closed.

In all other respects, the container 3 can be of arbitrary configuration. For example, it can be a closeable container which can also be partitioned. It is only necessary for this container 3 to have a side strip with the associated teeth 34 so to form a connection between the container 3 and the carrier system 2 together with the interacting teeth 28 of carrier system 2.

Figure 9:
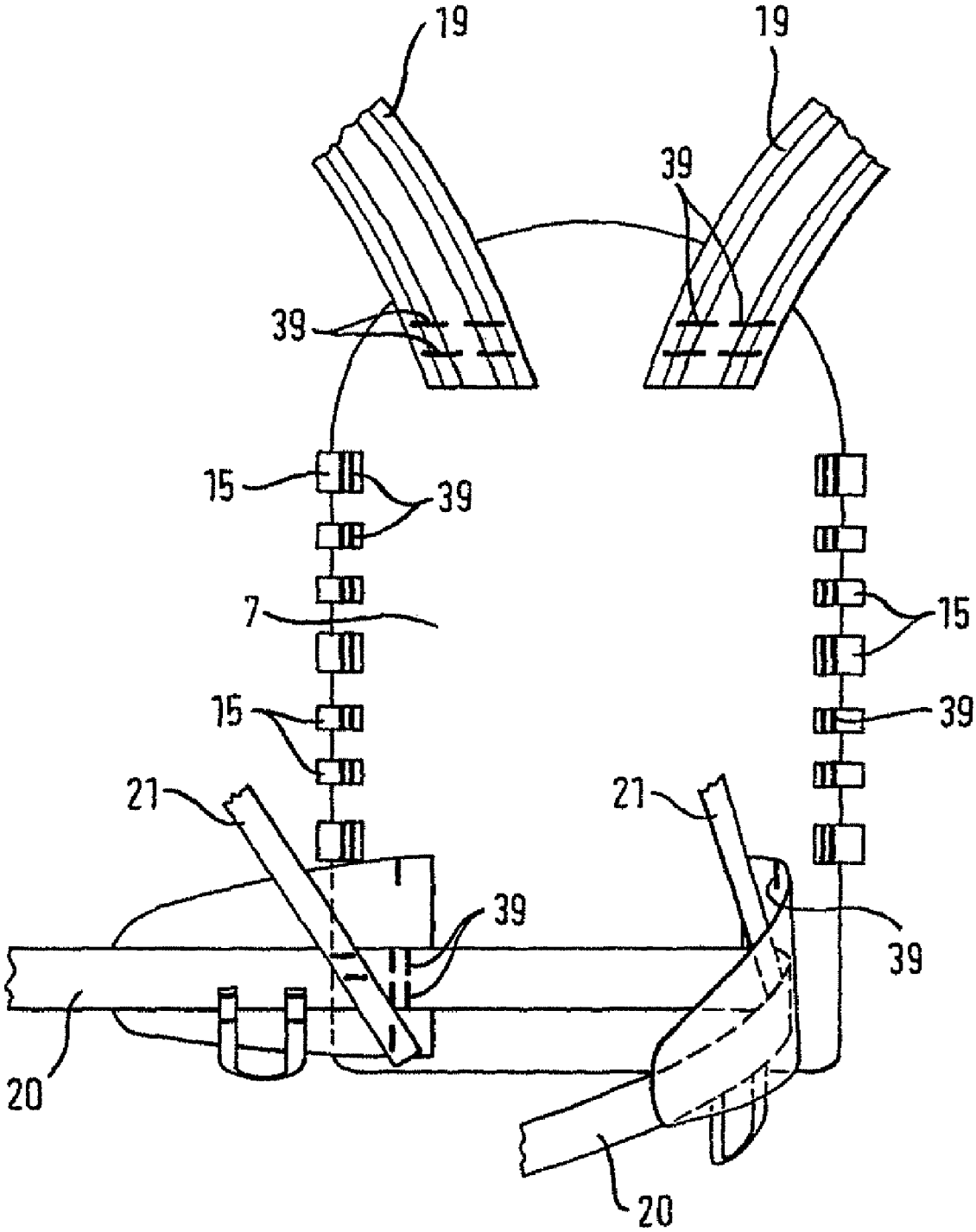

In the embodiment shown in FIG. 9, the carrier system 2 is essentially composed of fabric 7, which represents the "rear side" of carrier system 2. The shoulder strap 19, the waist strap 20 and the hip strap 21 are directly connected to this fabric 7 by seams 39. The entire force is thereby absorbed by fabric 7.

Loops 15 serve to affix the not shown buoyant body, said loops being likewise directly connected to fabric 7 via seams 39.

Instead of the individual loops 15, a strap band 40 with associated loops 15 as shown in the FIG. 8 embodiment can of course also be used.

It is furthermore conceivable to join the segments or areas of the previously-described base strap 4 to fabric 7.

LIST OF REFERENCE NUMERALS

1 avalanche rescue device
2 carrier system

3 container
4 base strap
5 side leg
6 base/segment
7 planar textile
8 end
9 rod
10 loops
11 compressed gas tank
12 line
13 pocket
14 pocket
15 loop
16 flap
17 Velcro strip
18 Velcro strip
19 shoulder strap
20 waist strap
21 hip strap
22 buoyant body
23 elastic layer
24 band of fabric
25 left edge
26 connecting point
27 right vertical edge
28 teeth
29 side strips
30 Velcro strip
31 Velcro strip
32 second side strip
33 edge
34 teeth
35 side strip of container
36 slider
37 front face
38 loop
39 seam
40 strap band

The invention claimed is:

1. An avalanche rescue device comprising at least one inflatable buoyant body attachable close to a body of a user, a filling unit for said buoyant body, a compressed gas unit having a compressed gas tank and a release unit, and a carrier system enabling a user to carry said buoyant body and compressed gas unit on his or her back; said carrier system comprising at least one flexible fabric element and a first connecting mechanism which interacts with a second connecting mechanism of a separate container such that the carrier system is detachably connectable to the container to form a jointly-manipulable backpack and which is sandwiched between the user's back and the container in a conjoined state;

wherein the carrier system has the first connecting mechanism located around a periphery thereof, and wherein the separate container is connected by the second connecting mechanism to the first connecting mechanism located around the periphery of the carrier system.

2. The avalanche rescue device according to claim 1, wherein the flexible fabric element is constituted of a planar textile.

3. The avalanche rescue device according to claim 1, wherein the flexible fabric element constitutes a strap.

4. The avalanche rescue device according to claim 1, wherein the first and second connecting mechanisms are respectively formed by side strips provided with teeth to form a zipper together with a slider.

5. The avalanche rescue device according to claim 4, wherein the side strips of the zipper are respectively mounted on an outer side of the carrier system and the container, and nearly wholly ring the carrier system and the container.

6. The avalanche rescue device according to claim 1, wherein the container is substantially self-contained, and provided with at least one closeable opening through which the interior of the container is accessible from outside.

7. The avalanche rescue device according to claim 1, wherein a front face of the container covers and/or closes a rear face of the carrier system.

8. The avalanche rescue device according to claim 1, wherein the carrier system has a U-shaped base strap in plan view with side legs and a base, and the side legs of said base strap extend vertically in a use position while the base of the U-shaped base strap forms a horizontally-extending segment thereabove.

9. The avalanche rescue device according to claim 8, including a waist strap connected to the base strap near the free ends of the U-shaped base strap.

10. The avalanche rescue device according to claim 8, including two buoyant bodies, each respectively connected to a vertical leg of the U-shaped base strap.

11. The avalanche rescue device according to claim 6, wherein the upper ends of a left and a right shoulder strap are affixed to the horizontally-extending segment of the U-shaped base strap, a right and a left hip strap are respectively connected to the base strap at a lower end thereof or in the area of a lower end of a vertical leg of the U-shaped base strap, and the right shoulder strap is connectable to the right hip strap and the left shoulder strap is connectable to the left hip strap to form a harness.

* * * * *